US006615897B2

(12) United States Patent
Dorma

(10) Patent No.: US 6,615,897 B2
(45) Date of Patent: Sep. 9, 2003

(54) APPARATUS FOR WINDING A SPRING

(75) Inventor: Edward Dorma, Sarasota, FL (US)

(73) Assignee: Industrial Door Company, Inc., Coon Rapids, MN (US)

( * ) Notice: Subject to any disclaimer, the term of this patent is extended or adjusted under 35 U.S.C. 154(b) by 0 days.

(21) Appl. No.: 10/166,526

(22) Filed: Jun. 10, 2002

(65) Prior Publication Data

US 2002/0162634 A1 Nov. 7, 2002

Related U.S. Application Data

(62) Division of application No. 09/361,770, filed on Jul. 27, 1999, now Pat. No. 6,408,925.

(60) Provisional application No. 60/094,728, filed on Jul. 30, 1998.

(51) Int. Cl.[7] ..... E05F 11/00

(52) U.S. Cl. ..... 160/191; 160/318; 242/375.1; 185/37; 267/155; 16/197

(58) Field of Search ..... 160/313, 315, 160/318, 191, 192, 201; 16/197; 242/375.1, 375.2, 375.3; 49/200; 185/37, 39, 45; 267/155

(56) References Cited

U.S. PATENT DOCUMENTS

| | | | | |
|---|---|---|---|---|
| 748,641 | A | | 1/1904 | Newell |
| 873,438 | A | * | 12/1907 | John, Jr. |
| 1,416,071 | A | * | 5/1922 | Smurr |
| 1,641,506 | A | | 9/1927 | Smurr |
| 2,350,286 | A | | 5/1944 | Michelman |
| 3,635,277 | A | | 1/1972 | Bahnsen |
| 3,685,567 | A | | 8/1972 | Pemberton et al. |
| 3,921,761 | A | | 11/1975 | Votroubek et al. |
| 3,979,977 | A | | 9/1976 | Dorma |
| 4,427,050 | A | * | 1/1984 | Toppen |
| 4,523,620 | A | | 6/1985 | Mortellite |
| 4,681,279 | A | | 7/1987 | Nakamura |
| 4,817,927 | A | | 4/1989 | Martin |
| 4,882,806 | A | | 11/1989 | Davis |
| 4,930,182 | A | | 6/1990 | Eichenberger |
| 4,981,165 | A | | 1/1991 | Miller et al. |
| 5,078,198 | A | | 1/1992 | Tedeschi |
| 5,239,777 | A | | 8/1993 | Husselton |
| 5,419,010 | A | | 5/1995 | Mullet |
| 5,522,446 | A | | 6/1996 | Mullet et al. |
| 5,568,672 | A | | 10/1996 | Mullet et al. |
| 5,577,544 | A | | 11/1996 | Carper et al. |
| 5,615,723 | A | | 4/1997 | Carper |
| 5,632,063 | A | | 5/1997 | Carper et al. |
| 5,636,678 | A | | 6/1997 | Carper et al. |
| 5,865,235 | A | | 2/1999 | Krupke et al. |
| 5,964,268 | A | | 10/1999 | Carper et al. |
| 5,964,426 | A | | 10/1999 | Tabellini |
| 5,996,923 | A | * | 12/1999 | Junquera |
| 6,089,306 | A | | 7/2000 | Frey, Jr. |
| 6,135,189 | A | * | 10/2000 | Weinreich |
| 6,330,903 | B1 | * | 12/2001 | Weinreich |
| 6,408,925 | B1 | * | 6/2002 | Dorma |

FOREIGN PATENT DOCUMENTS

| | | |
|---|---|---|
| DE | 43 41 309 C1 | 3/1995 |

OTHER PUBLICATIONS

EZ–Set Torsion Spring System information, © 1997 Clopay Building Products Co., A Griffon Company.
EZ–Set Torsion Spring System information, © 1998 Clopay Building Products Co., A Griffon Company.

* cited by examiner

*Primary Examiner*—Blair Johnson
(74) *Attorney, Agent, or Firm*—Kinney & Lange, P.A.

(57) ABSTRACT

An apparatus for winding a spring on a shaft, such as for counterbalancing a roll-up door, includes a housing that carries a transmission which is positionable over the shaft. The transmission is configured to be coupled via a connector to one end of the spring, while the other end of the spring is fixed to the shaft. Rotation of the transmission results in a turning of the connector and a winding and/or elongation of the spring.

9 Claims, 10 Drawing Sheets

APPARATUS FOR WINDING A SPRING

REFERENCE TO CO-PENDING APPLICATIONS

This is a divisional of application Ser. No. 09/361,770, filed on Jul. 27, 1999, now U.S. Pat. No. 6,408,925 which is a non-provisional of provisional application Serial No. 60/094,728, filed Jul. 30, 1998. Priority of the prior applications is claimed pursuant to 35 U.S.C. §120.

BACKGROUND OF THE INVENTION

This invention relates to torsion spring counter balancing mechanisms for compensating the weight of roll-up doors and a method and structure for accommodating coil torsion spring growth as the door moves up and down between its open and closed positions.

Counterbalancing mechanisms of overhead garage doors utilize coil springs that are placed under a rotational or torsion force to apply a lifting force to the door. The springs are concentrically positioned about a shaft rotatably mounted on fixed supports. The shaft carries hubs accommodating cables. The cables arc attached to the door so that when the hubs are rotated, a lifting force will be applied to the door. The lifting force is transmitted to the hubs via the shaft by the torsion springs. The spring must be twisted to load the spring or place the spring under torsion force. Heretofore, long rods have been used to turn the collar attached to the spring to load the spring. This usually requires two men. A limited amount of force can be applied to the spring since twisting the collar is a manual operation. The procedure requires a considerable amount of time and can be dangerous as the spring is loaded with considerable force. A power tool used to apply torsion forces to the counterbalancing spring of a roll-up door is disclosed by E. Dorma in U.S. Pat. No. 3,979,977. One embodiment of this power tool has a power transmission operated with a portable externally located electric motor. Worm gear power transmission units have been incorporated in door counterbalancing mechanisms. Examples of this type of power transmission unit to wind or twist torsion springs are disclosed by L. C. Votroubek and D. H. Nelson in U.S. Pat. No. 3,921,761. Votroubek and Nelson recognize the danger involved in winding and unwinding a garage door torsion spring and attempt to address this problem. Votroubek utilized a tool with a self-locking worm drive gear and worm wheel which can be put into place about the torsion shaft to effect a gripping of an end collar for connecting the spring to the torsion shaft. After the collar is gripped, the end collar is released from the shaft for movement along the rotation about the torsion shaft. In Votroubek, the tool is mounted on the torsion shaft and blocked against rotation about the torsion shaft in a manner to allow the tool to move axially of the torsion shaft, as the spring is wound, to accommodate the growth of the spring during winding. In a double spring configuration using the Votroubek tool, the springs would be wound and unwound separately with the tool being used to wind the outer-end of each spring.

While Votroubek's tool lessens danger, as compared to the conventional use of a lever bar for winding or unwinding a spring, the spring end is still held by a tool which is separate from the hardware of the mechanism and which must be assembled and disassembled to the counterbalancing mechanism for each winding, unwinding or adjustment of a torsion spring. This tool also must be securely blocked against rotation as a whole about the axis of the torsion rod each time a spring end is to be wound or unwound. Further, during the use of the tool, as in the case of using a lever bar, the door being counterbalanced is placed in a locked position until the winding operation has been completed and the freed end cones or members of the spring are re-secured to the torsion shaft. With the door locked, the setting of the proper spring forces in the torsion spring or springs is done with the use of charts and spring characteristic specifications. When working in this manner, it is difficult to achieve the proper counterbalancing forces, as is true of all the present conventional methods known to applicant, for setting the torsion in a torsion counterbalancing mechanism for a garage door.

Conventional torsion springs used in door counterbalance mechanisms have adjacent coils that engage or abut one another when the spring is in its normal unwound resting state. There is no gap between adjacent coils. During the winding process of a torsion coil spring friction forces are generated between adjacent coils of the spring. Coil torsion springs having abutting coils that do not provide for growth and contraction of the spring during the initial winding of the spring and of spring unwinding and winding during raising and lowering of the door. Carper et al in U.S. Pat. No. 5,632,063 uses a sliding cone to anchor an end of the torsion spring to the shaft to allow the spring to elongate and contract as the door opens and closes. This requires a modification of the end cone and rod as the cone must axially move on the rod. Conventional shafts and end cones for the torsional coil spring cannot be used in this door counterbalancing system.

It is the object of the present invention to eliminate the dangers of prior art mechanisms relating to torsion spring counterbalancing and to simplify the installation and maintenance with an accompanying savings in time and labor, and to improve the system performance and provide an extended life for the parts of the counterbalance mechanism.

BRIEF SUMMARY OF THE INVENTION

The present invention is an apparatus for applying a torsion force to a spring on a shaft, such as for counterbalancing a roll-up door, wherein a first end of the spring is secured to the shaft. The apparatus comprises a housing that contains a transmission to which is coupled a connector. The connector is con figured to be positioned coaxially over the shaft and connected to a second end of the spring. In one embodiment, the transmission comprises a worm gear meshed with a wheel gear. The connector is coupled to the wheel gear, such that rotation of the worm gear causes a rotation of the connector, and hence a winding of the spring when the second end of the spring is connected to the connector.

DETAILED DESCRIPTION

Figure 1:
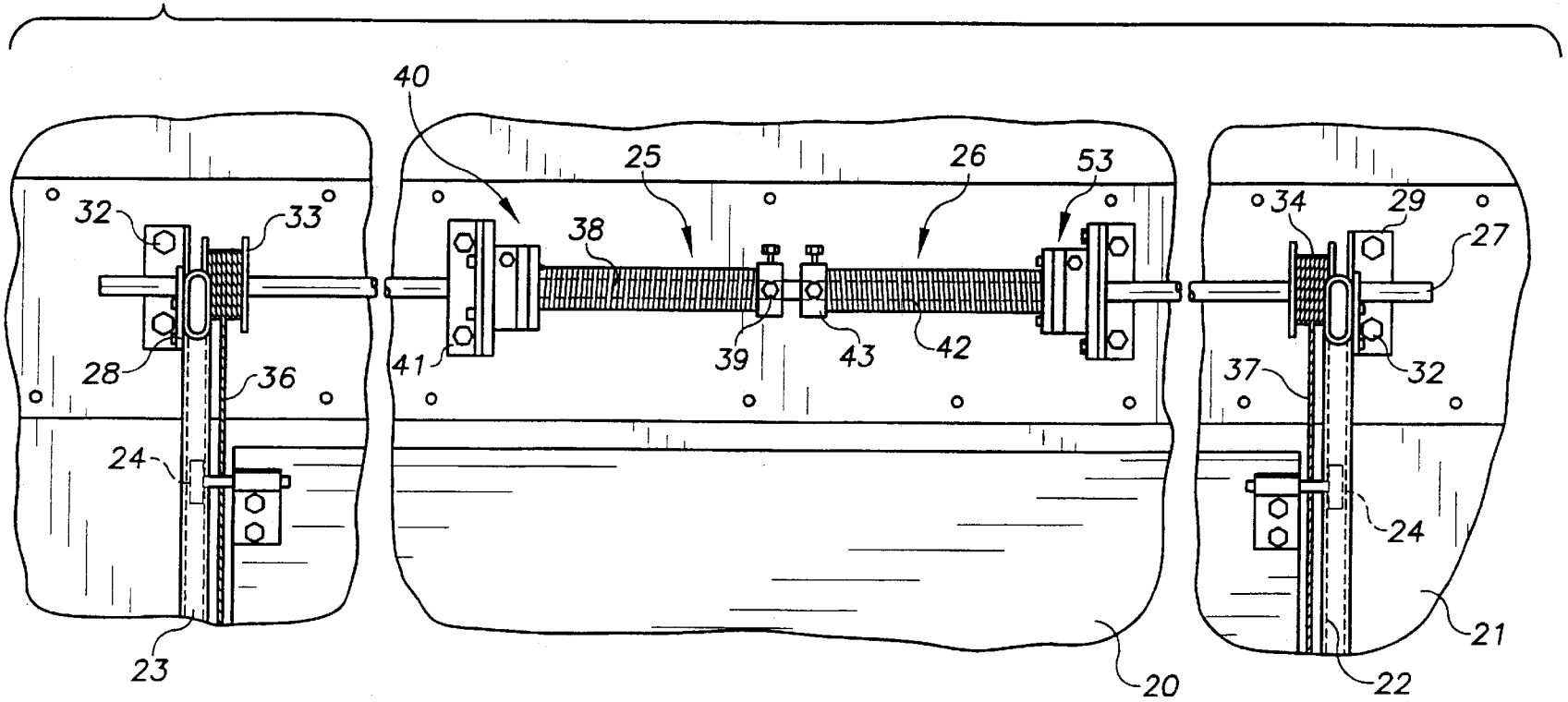
FIG. 1 is a fragmentary elevation view, partly sectioned, of a roll-up door equipped with the counterbalancing apparatus of the invention.

Referring to the drawings, there is shown in FIG. 1 an overhead roll-up door 20 in the closed position movably mounted on a structure 21, as a garage, warehouse or the like. Conventional tracks 22 and 23 having upright sections and generally horizontal sections are secured to the structure to movably support the door 20. A plurality of rollers 24 connected to separate portions of door 20 support the door on the tracks 22 and 23. The overhead door 20 is usually made of metal, plastic or wood panels and has considerable weight. Counterbalance mechanisms, indicated generally at 25 and 26, are used to facilitate opening the door 20 and return or slow closing the door.

Counterbalance mechanism 25 and 26 are located above the top of the door 20 and has a generally transverse shaft 27. Opposite end portions of shaft 27 are rotatably supported on support blocks 28 and 29. A plurality of fasteners 32 secure the blocks 28 and 29 to structure 21 located adjacent the top of door 20. In some installations, the shaft 27 is rotatably supported on the remote ends of the tracks 22 and 23. A first drum 33 carrying a cable 36 is secured to the left end of shaft 27. The lower end of cable 36 is connected with a suitable fastener (not shown) to the bottom of door 20. In a similar manner, a second drum 34 is fixed to the right end of shaft 27. A cable 37 wrapped around drum 34 extends downwardly and is attached to the lower end of door 20.

Shaft 27 is subjected to rotational or torsion forces by a pair of coils or helical torsion springs 38 and 42. One end of spring 38 is secured to an anchor 39 attached to shaft 27. The opposite end of spring 38 is operatively connected to a non-back drive power transmission unit 40. Unit 40 is attached to a bracket 41 mounted on structure 21. Unit 40 can be secured directly to support block 28 to anchor unit 40 on structure 21.

The second counterbalancing mechanism 26 has a second torsion spring 42 located over shaft 27 and secured to shaft 27 with an anchor or plug 43. The free end of spring 42 is attached to a transmission unit 53. The counterbalancing mechanisms 25 and 26 have the same structures and operate to apply torsion on springs 38 and 42, thereby subjecting the shaft to torque the counterbalance of the weight of door 20. The following description is directed to counterbalancing mechanism 26. In some installations a single torsion spring and non-back drive power transmission unit is used to apply tension bores to shaft 27 to wind spring 42 and adjust the tension of spring 38.

When the door 20 is in its closed position, springs 38 and 42 are fully energized by the twisting action of shaft 27. The shaft 27 rotates as door 20 moves to its closed position, thereby subjecting springs 38 and 42 to twisting forces which store sufficient energy to counterbalance a substantial portion of the weight of door 20. Springs 38 and 42 have sufficient energy so that a small amount of lifting force applied to door 20 will open the door. Springs 38 and 42 must be subjected to torsion forces when the door is open so that the springs will hold the door in the open position.

Figure 2:
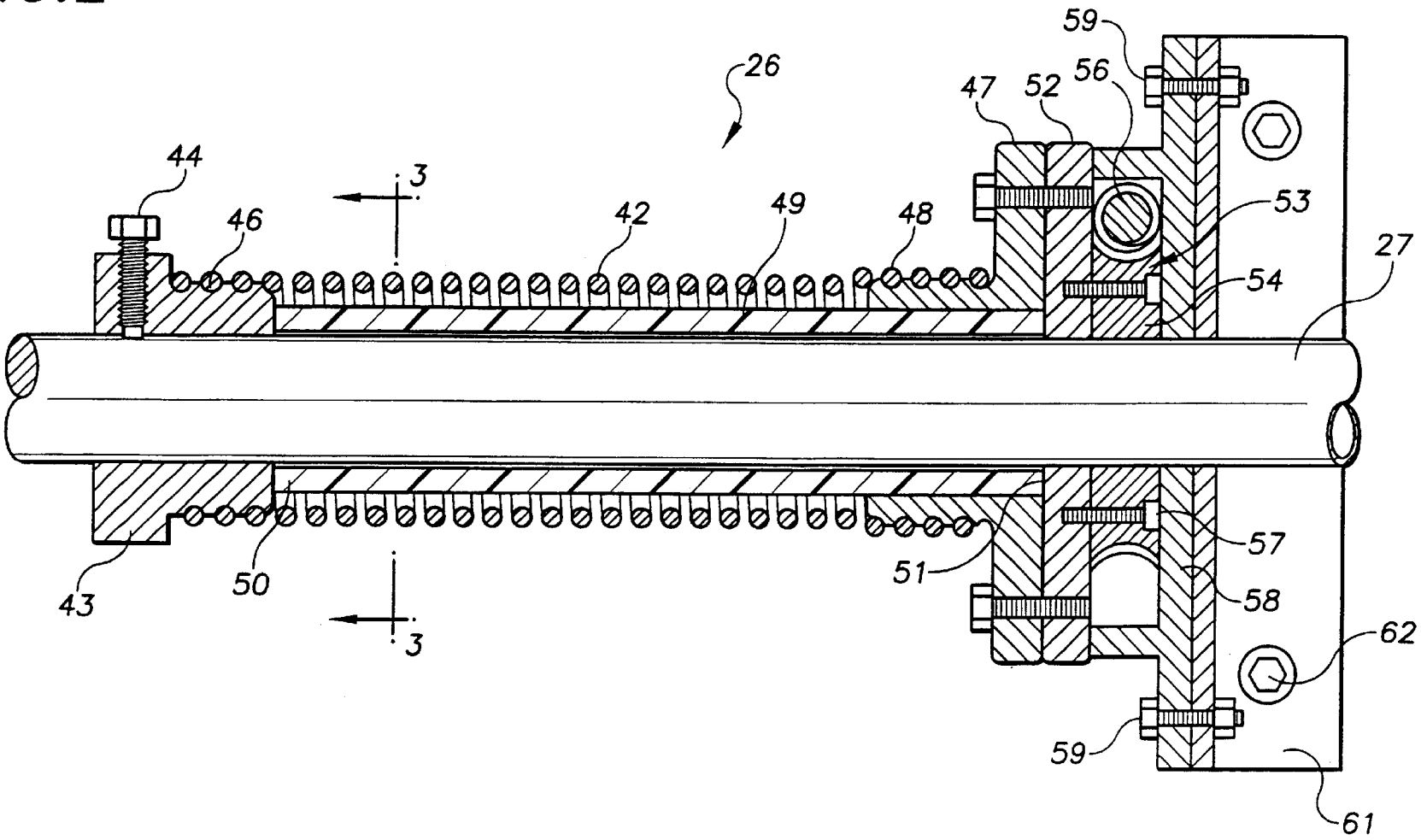
FIG. 2 is an enlarged vertical sectional view of a counterbalancing apparatus showing the torsion spring and worm gear unit for applying torque tot he torsion spring.

Roll-up door counterbalancing mechanism 26 operates to apply torque or torsion force to a shaft 27 connected to drums and cables to counterbalance a roll-up door 20. FIG. 1 shows the shaft and drums accommodating cables connected to the bottom of a roll-up door. A first end cone or plug 43 secured to shaft 27 with set screws 44 is threaded into an end 46 of torsion spring 42, as shown in FIG. 2. A second end cone or plug 47 is threaded into end 48 of spring 42. The spring 42 and end cones 43 and 47 are conventional structures. The adjacent coils of spring 42 normally engage each other as shown in FIG. 1.

Referring to FIG. 2, an elongated tubular member 49 surrounding shaft 27 is located within spring 42. Member 49 has an end 50 that abuts against plug 43. The opposite end 51 of member 49 stretches or longitudinally elongates spring 42 about 2½ inches (i.e., the length that spring 42 grows when wound). Spring 42 increases in length by the diameter of spring wire for every turn, 360°, of the spring. Adjacent coils of the spring are spaced from each other, as shown in FIG. 2, by the tubular member 49 which pre-stretches the spring.

As further shown in FIG. 2, a transmission unit 53 driven with a conventional electric motor drill, as shown in 143 in U.S. Pat. No. 3,979,977, turns end plug 47 to wind spring 42. Transmission unit 53 retains spring 42 in the wound position as it does not have back or reverse drive. Transmission unit 53 is also used to adjust the tension of spring 42. Transmission unit 53 has a gear 54 and a worm 56. Bolts 57 secured gear 54 to plate 52. Worm 56 has opposite ends rotatably mounted on a housing 58. Bolts 59 secure housing 58 to a bracket 61 or similar fixed support. The transmission unit 53 can be planetary or epicyclic train of gears that does not have back drive. A worm gear box having planetary gears, shown in FIGS. 9, 10, and 11 can be used to wind spring 42.

Figure 5:
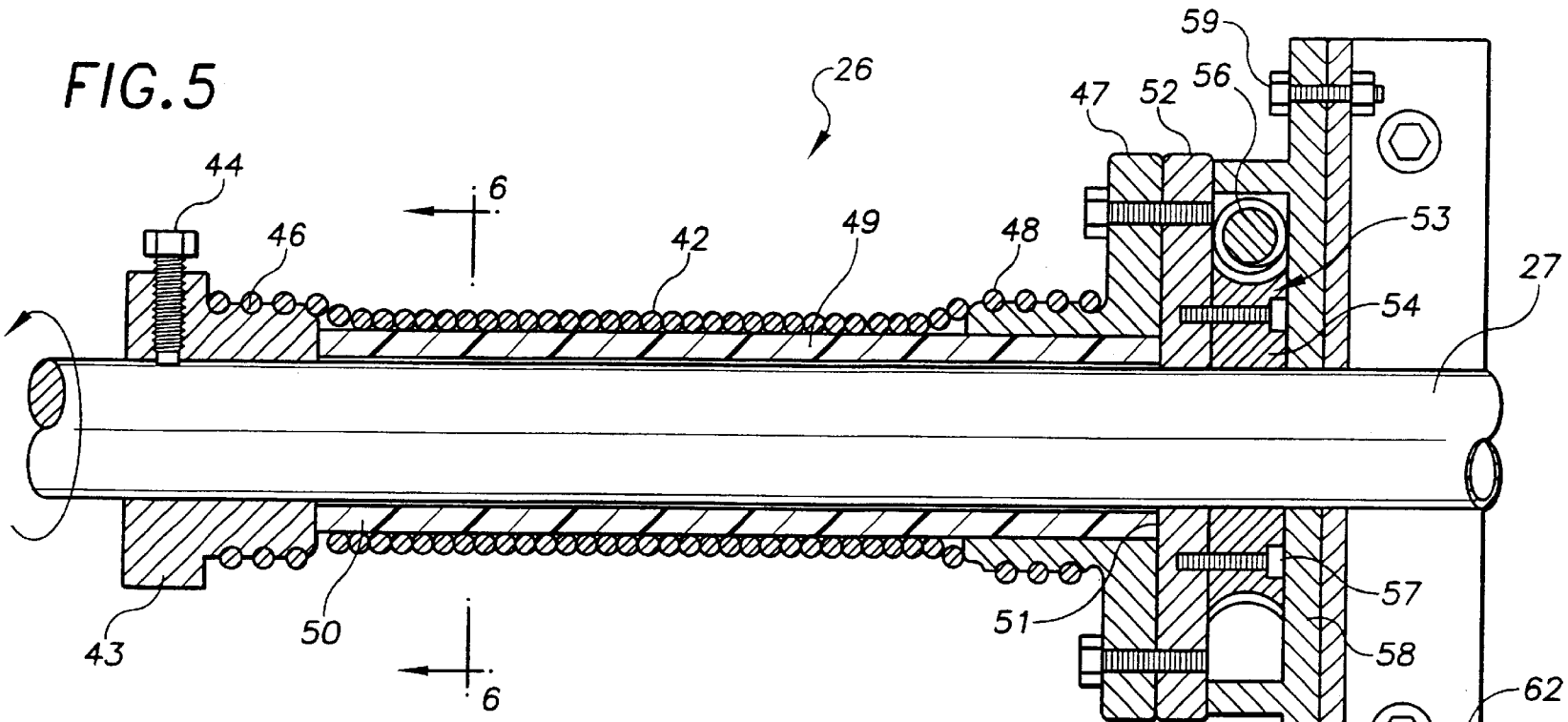
FIG. 5 is a sectional view similar to FIG. 2 showing the spring wound to apply torsion force to the counterbalancing shaft.
Figure 6:
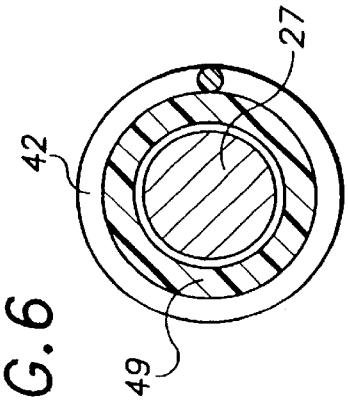
FIG. 6 is a sectional view taken along line 6—6 of FIG. 5.

In use an electric drill or wrench is used to turn worm 56 to rotate gear 54 about 6½ and 7½ turns to wind up spring 42. When spring 42 is would adjacent coils are in close relationship as shown in FIGS. 5 and 6. Spring 42 is not bound when it is fully wound up. Transmission unit 53, shown as a worm gear box, retains spring 42 in its wound position.

Figure 4:
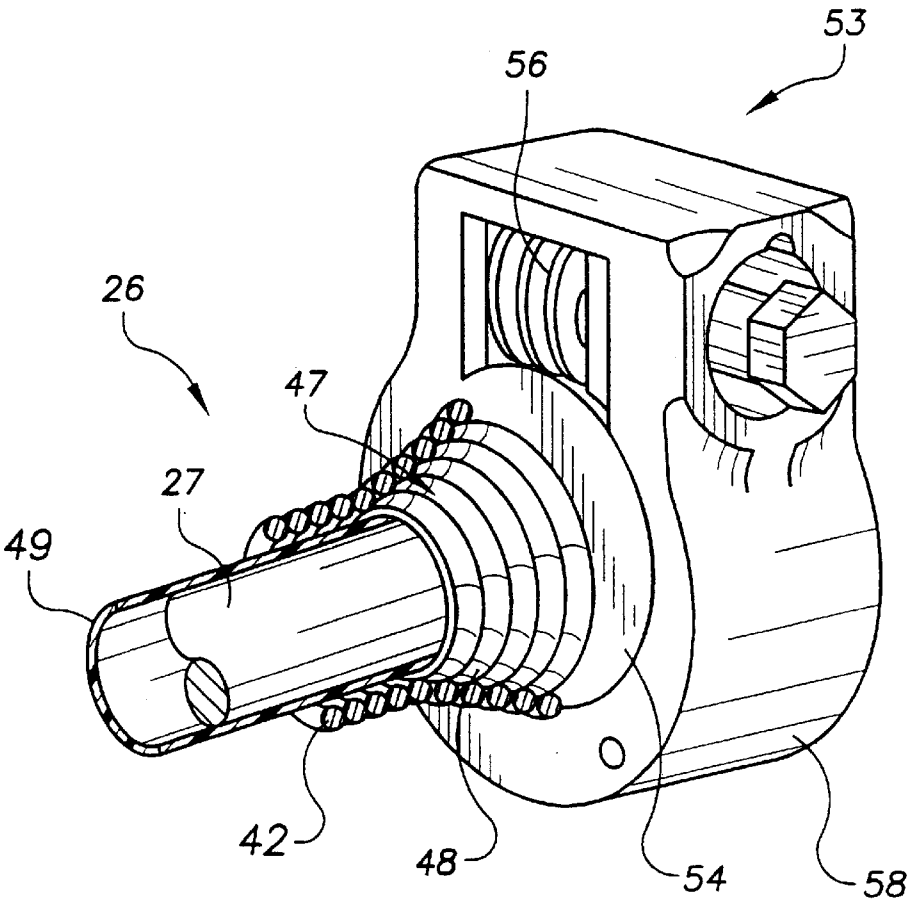
FIG. 4 is a perspective view of a door counterbalancing apparatus including the non-back drive power transmission for twisting the torsion springs
Figure 3:
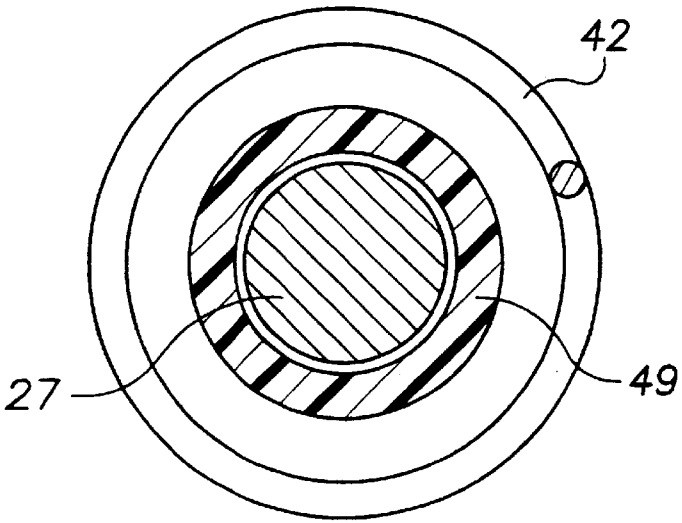
FIG. 3 is an enlarged sectional view taken along the line 3—3 of FIG. 2.
Figure 7:
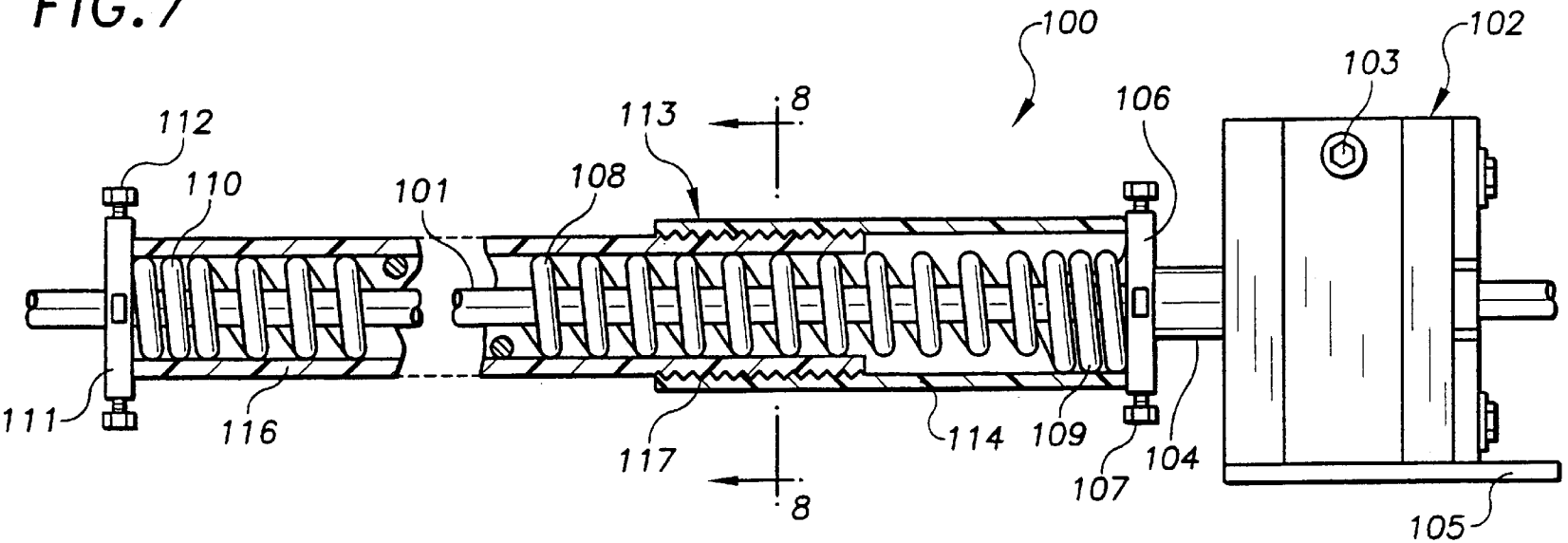
FIG. 7 is a sectional view similar to FIG. 2 showing a modification of the spring stretching assembly used to elongate the spring of the counterbalancing apparatus.
Figure 8:
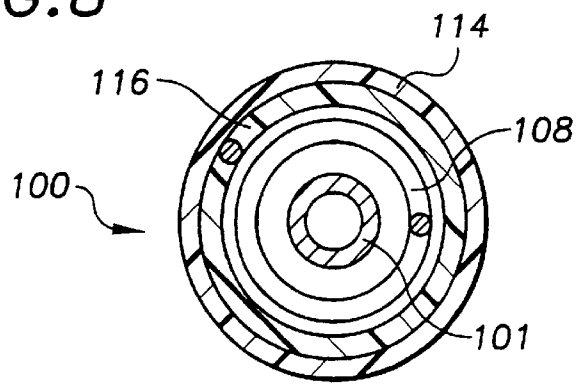
FIG. 8 is an enlarged sectional view taken along the line 8—8 of FIG. 7.

A modification of the roll-up door counter balancing assembly 100, shown in FIGS. 7 and 8, is located around horizontal shaft 101. Shaft 101 is a door lift shaft similar to shaft 27 shown in FIG. 1. A power transmission unit 102, such as a worm gear box, telescopes over shaft 101 and is secured to a fixed support with a bracket 105. Gear box 102 has a power input coupling 103 adapted to accommodate a socket or tool connected to a reversible electric motor, air motor, fluid motor or power means for rotating the input coupling 103 thereby operating gear box 102 to turn output shaft 104. Gear box 102 has the same operating gears as transmission unit 53 shown in FIG. 4. Other gear boxes, as shown in U.S. Pat. Nos. 4,882,806 and 4,981,165 can be used to turn coil spring 108 to apply torsion force to shaft 101.

An input end cone 106 secured to shaft 104 with set screws 107 is threaded into the first end 109 of spring 108. The opposite end 110 of spring 108 is threaded into an end cone 111. Set screws 112 anchor cone 111 to shaft 101. Shaft 101 extends axially through spring 108 and gearbox 102.

Spring 108 is a conventional closed metal coil spring having turns of uniform diameter. Adjacent turns normally contact each other. A spring stretching assembly 113 located about spring 108 longitudinally elongates spring 108 to allow for spring growth as it is turned or twisted to apply a torsion force to shaft 101. Spring stretching assembly 113 has a first tubular member 114 engageable with end cone 106. Member 116 telescopes into member 114. Members 114 and 116 have cooperating threads 117 that connect the members and allow longitudinal adjustment of the length of the spring stretching assembly 113. Tubular member 114 is rotated relative to tubular member 116 to elongate or stretch spring 108, as shown in FIG. 7. Set screws 112 are released to allow end cone 111 to slide on shaft 101. When spring 108 has been elongated, set screws 112 are turned down to anchor end cone 111 on shaft 101 and hold spring 108 in the stretched position. Spring stretching assembly 113 surrounds the entire spring 108 and provide a protective shield in the event of failure of part or parts of the spring. When spring 108 is wound or twisted the axial growth of the spring is compensated by the stretched spring. The gear box 102 functions as a power transmission that operates to twist spring 108 and hold the spring in its twisted position to maintain torsion force on shaft 101. Gear box 102 is also operated to adjust the tension of torsion force of spring 108.

Figure 9:
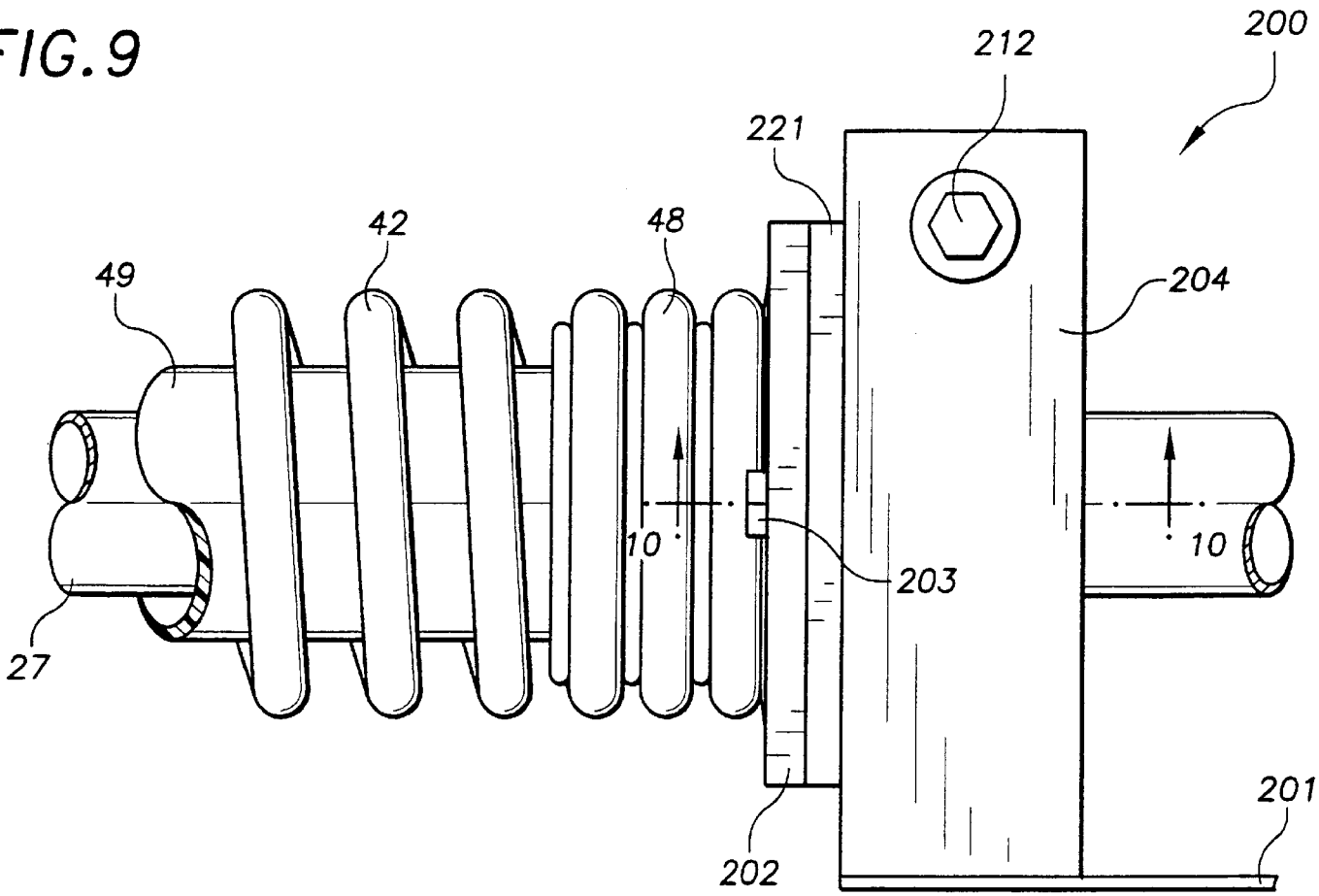
FIG. 9 is a front view of a worm gear assembly connected to a spring of the counterbalancing assembly of FIG. 2.
Figure 10:
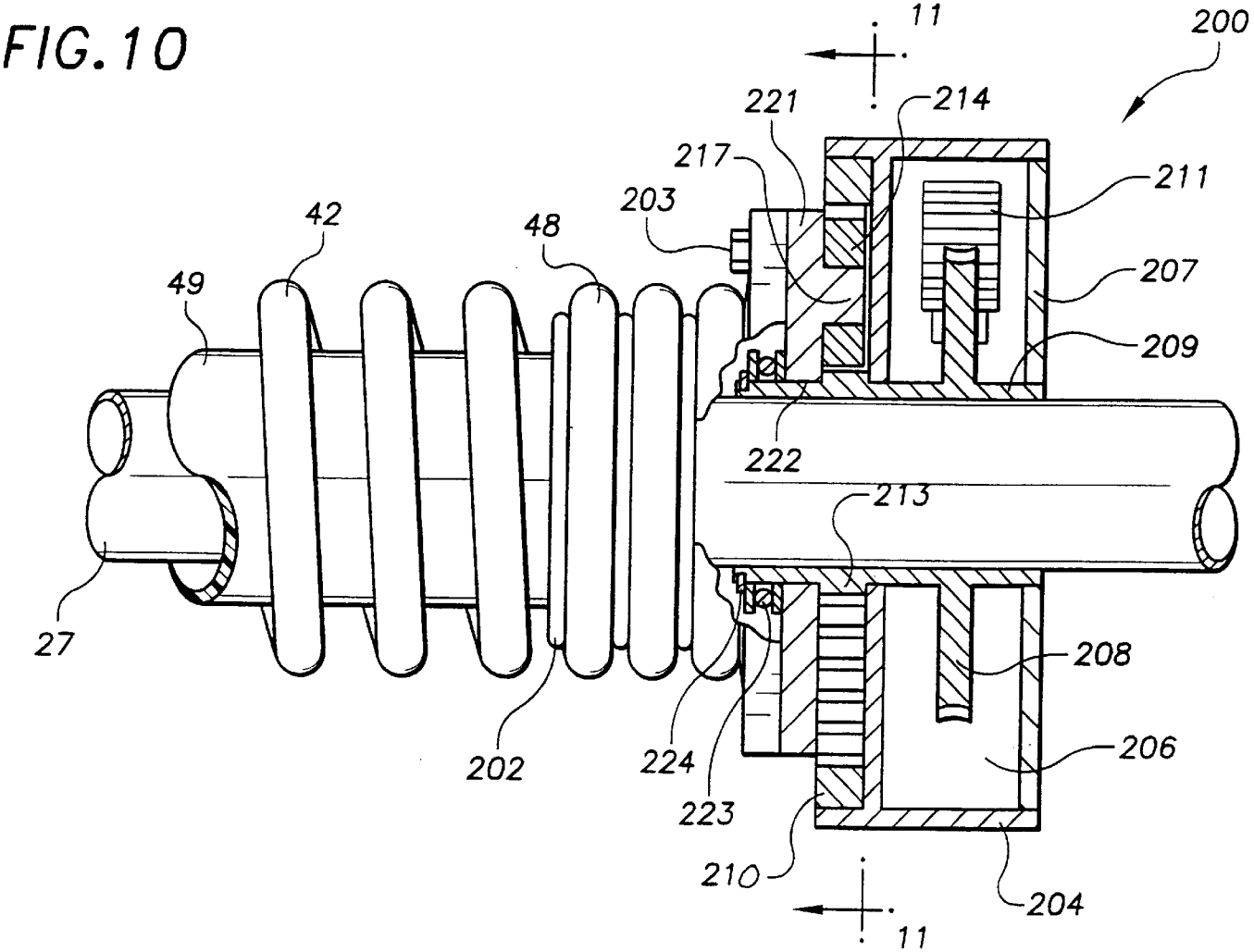
FIG. 10 is a sectional view taken along line 10—10 of FIG. 9.
Figure 11:
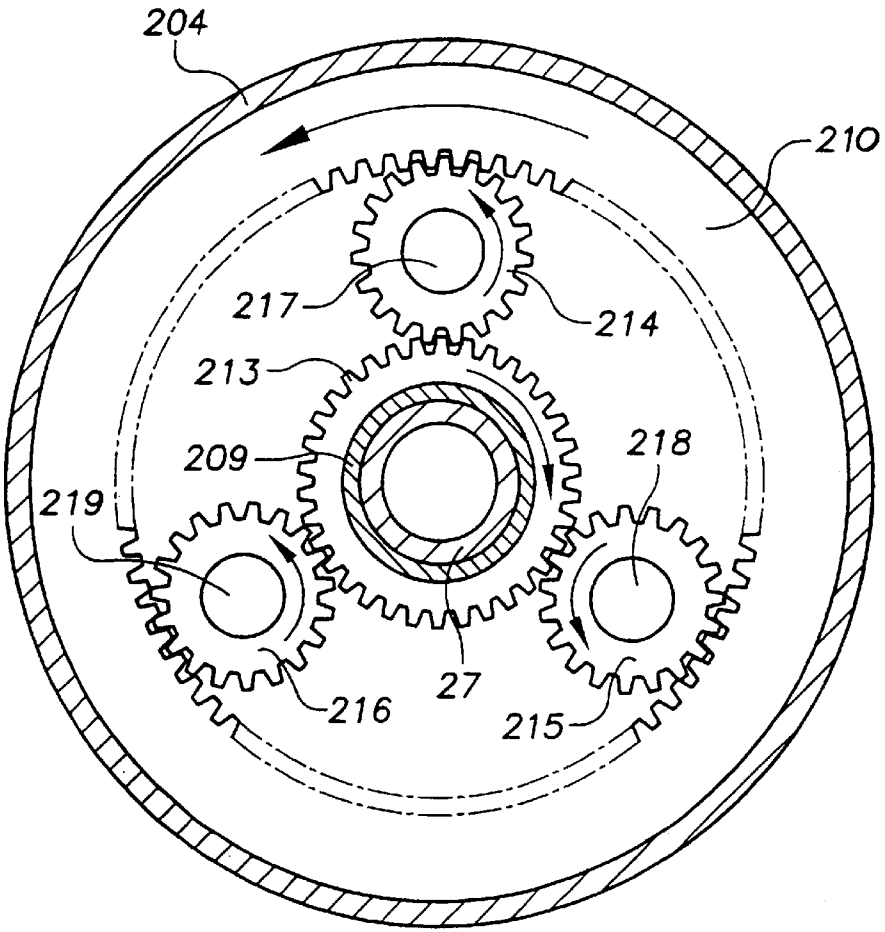
FIG. 11 is a sectional view taken along line 11—11 of FIG. 10.

A modification of the power transmission unit shown as a worm gear box 200, is represented in FIGS. 9, 10, and 11. Gear box 200 operates to wind spring 42 to apply torsion forces on shaft 27. Gear box 200 fits over shaft 27 and replaces transmission unit 53 (shown in FIG. 4). A bracket 201, such as a bearing plate, secured to the door frame or header is connected to gear box 200 to support and prevent rotation of gear box 200. An end cone 202 threaded into spring end 48 is connected to the output drive of gear box 200 with bolts 203.

As shown in FIG. 10, gear box 200 has a housing 204 surrounding a chamber 206 closed with an end plate 207. A worm gear 208 joined to a sleeve 209 is located within chamber 206. Sleeve 209 is rotatably mounted on shaft 27. A worm 211 rotatably mounted on housing 204 has teeth that engage the teeth of gear 208. As seen in FIG. 9, worm 211 has an external hexagonal end 212 for accommodating a socket of a power tool, such as an electric hand drill, used to rotate worm 211. The rotating worm 211 turns gear 208 and sleeve 209 about the axis of sleeve 209. Returning to FIGS. 10 and 11, a planetary gear assembly comprising a spur gear 213 secured to sleeve 209 engages planet gears 214, 215 and 216. A fixed ring gear 210 engages the teeth of planet gears 214, 215 and 216. Gear 217 is secured to housing 204. Planet gears 214, 215 and 216 are rotatably mounted on cylindrical bosses 217, 218 and 219 joined to a circular output drive disk or plate 221. Plate 221 has a central hole 222 accommodating sleeve 209. Bolts 203 connect end cone 202 to plate 221. Plate 221 is retained in assembled relation with sleeve 209 and gears 214,215 and 216 with a bearing 223. A snap ring 224 cooperating with sleeve 209 hold bearing 223 adjacent plate 221.

In use, sleeve 49 holds spring 42 in the elongated or stretched position. Adjacent coils of the spring 42 are separated from each other to compensate for spring growth during turning or twisting, of spring 49 by operation of gear box 200. A hand power tool, such as an electric drill or air operated motor equipped with a socket, is used to turn worm 211. The socket fits on hexagonal end 212 of worm 211 whereby torque can be transferred from the power tool to worm 211. The planetary gear assembly functions as a speed reducer that applies considerable twisting or torsional force to end cone 202 which winds spring 42. Relatively large coil springs can be wound with gear box 200 equipped with the planetary gear assembly. Gear box 200 can be used in the door counterbalancing mechanisms 26, 100 and 300 herein described.

Figure 13:
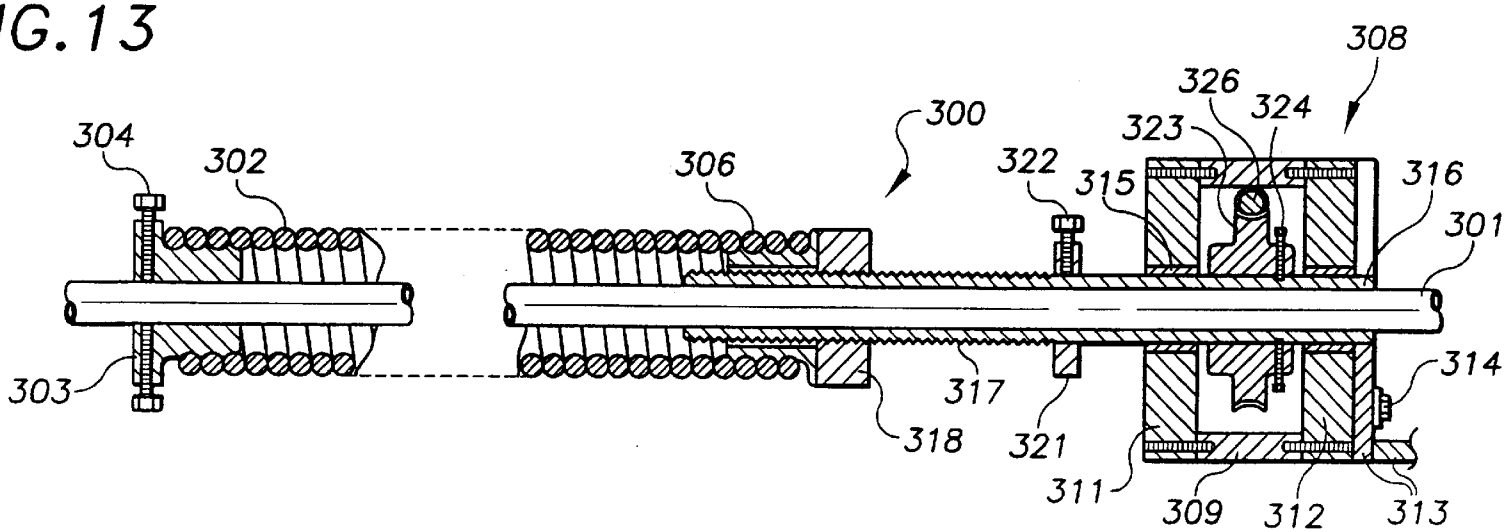
FIG. 13 is a foreshortened sectional view taken along line 13—13 of FIG. 12.
Figure 14:
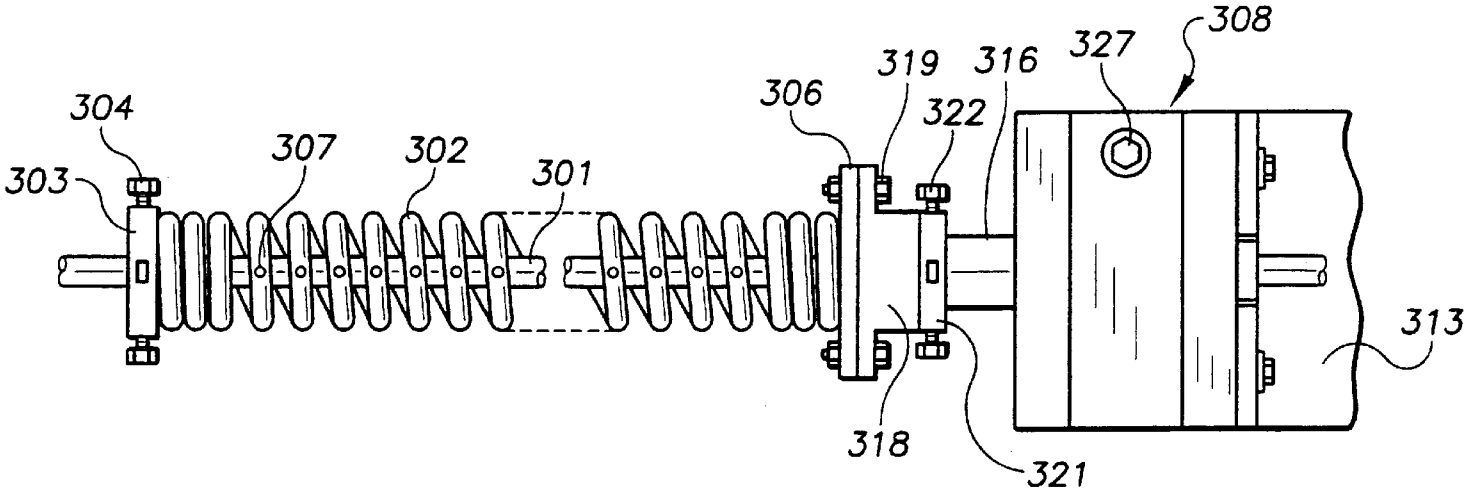
FIG. 14 is a foreshortened view similar to FIG. 12 showing the spring in the stretched position.
Figure 15:
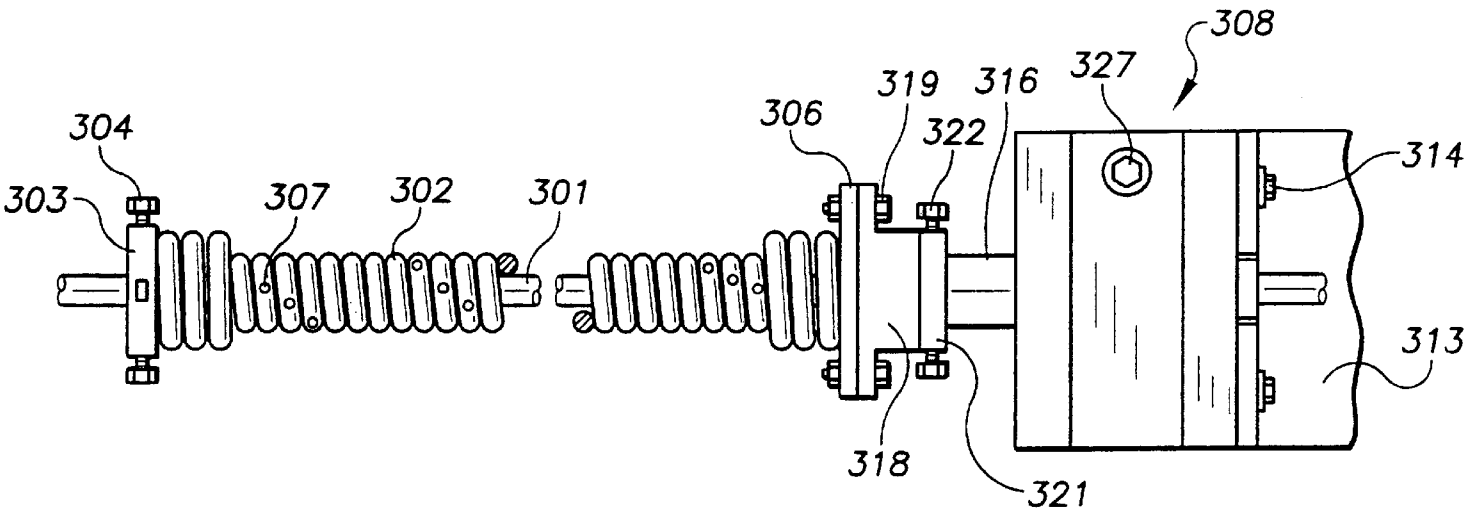
FIG. 15 is a foreshortened view similar to FIG. 12 showing, the spring wound to apply torsion force to the counterbalancing shaft.

Referring to FIGS. 12 to 15 there is shown another modification of the roll-up door counterbalancing assembly 300 of the invention for applying torsional force on shaft 301. Shaft 301 corresponds to shaft 27 connected to cable drums 33 and 34. Assembly 300 has a coil spring 302 having adjacent coils contacting each other. Spring 302 is made from metal rod stock which is helically wound into an elongated cylindrical coil spring. An end cone 303 turned into the distal end of spring 302 is anchored to shaft 301 with set screws 304. A second end cone 306 is turned into the proximal end of spring 302. The side of spring 302 is marked with color spots 307, such as white paint, used to provide a visual image of the number of turns or twists of the spring as shown in FIG. 15.

A power transmission unit, shown as a worm gear box 308, mounted on shaft 301 is operable to elongate spring 302, twist spring 302, and hold spring 302 in its twisted or torsion position thereby subjecting shaft 301 to a torsion force which counterbalances the roll-up door. Gear box 308 has a housing 309 accommodating end plates 311 and 312. A bracket 313 attached to end plate 313 with bolts 314 secures gear box 308 to a support, such as a door frame or header. Other structures can be used to attach gear box 308 to a fixed support. End plates 311 and 312 support central bearings 315 that rotatably engage an elongated sleeve 316. Sleeve 316 extends through gear box 308 and into spring, 302. The outer section of sleeve 316 has threads 317. A nut or threaded block 318 cooperatively engages threads 317 whereby upon rotation of sleeve 316 block 318 moves along sleeve 316 to expand or stretch spring 302 as shown in FIG. 14. Bolts 319 connect block 318 to end cone 306. An annular stop collar 321 surround sleeve 316 to limit axial movement of block 318. Set screws 322 anchor collar 321 to sleeve 316 and allow the position of collar 321 to be adjusted relative to sleeve 316. This adjustment is used to control the amount of stretch of spring 302.

A worm gear 323 within gear box 308 is driveably connected to sleeve 316 with set screws 324. Splines and keys can be used to connect gear 323 to sleeve 316. A worm 326 rotatably mounted on housing 309 has threads that cooperate with the threads of gear 323. Worm 326 has an exterior hexagonal end 327 adapted to receive a socket on a power tool or socket wrench used to operate the worm gear box.

Figure 12:
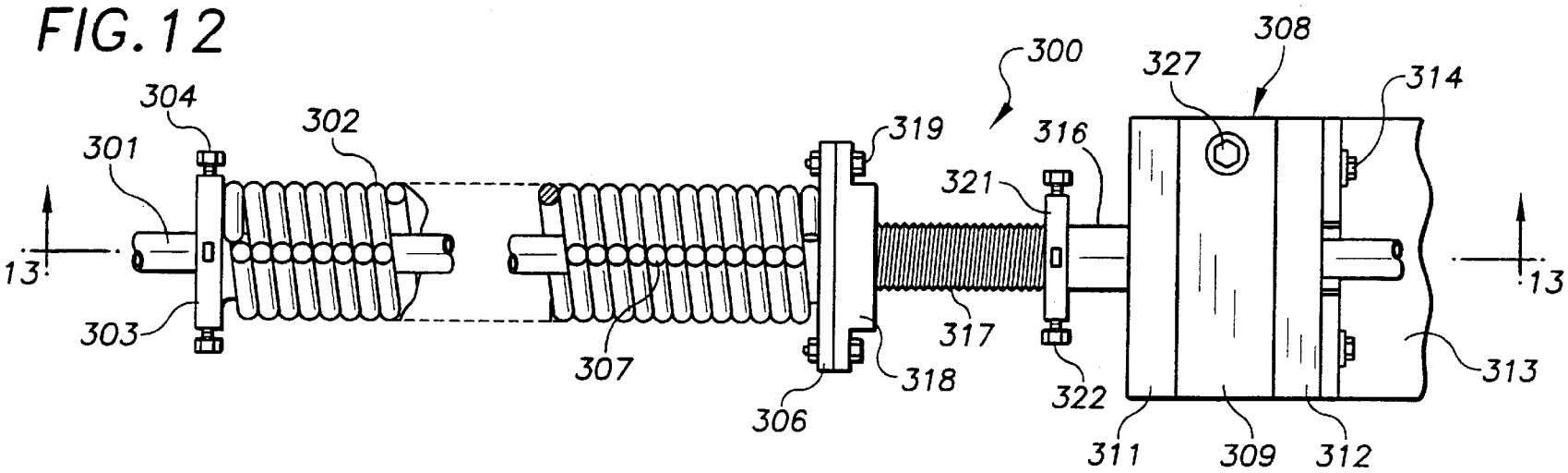
FIG. 12 is a foreshortened front view of a modification of the roll-up door balancing apparatus of the invention.

Rotation of worm 326 with a power tool, such as a portable electric drill, turns gear 323 and sleeve 316. As shown in FIG. 12, gear box 308 is attached to a fixed part of the door structure and spring 302 is placed on shaft 301 in its normal closed position. End cones 303 and 306 have been threaded into opposite ends of springs 302 before they are assembled about shaft 301. Shaft 301 is moved through sleeve 316. Opposite ends of the shaft 301 are attached to drums, such as drums 33 and 34 accommodating cables which are attached to bottom portions of the roll-up door.

The block 318 is turned to move it toward the end of the threaded section 317*b* of sleeve 316, as shown in FIGS. 12 and 13. End cone 306 is attached with bolts 319 to block 318. Spring 302 in its normal non-tension condition extends along shaft 301. End cone 303 is anchored to shaft 301 with set screws 304 to fix the position of end cone 303 on shaft 301. Stop collar 321 is positioned a selected distance from block 318 and anchored to sleeve 316 with set screws 322. Spring 302 increases in length by a distance equal to the diameter of the spring coil or wire for each 360 degree turn of the spring. The spacing between block 318 and stop collar is determined by the diameter of the coil and the desired number of turns of the spring.

A power tool, such as a portable electric drill, connected to a socket is used to rotate worm 326 which turns gear 323 and sleeve 316. Block 318 during rotation of sleeve 316 does not turn with sleeve 316 as it is prevented from turning by the resistance of the spring to twist. Block 318 moves toward stop collar 321 until it contacts collar 321. Further movement of block 318 on sleeve 316 is terminated when block 318 contacts collar 321. Spring 302, as shown in FIG. 14, is expanded or stretched. Adjacent spring coils are spaced from each other to provide spaces for growth of the spring as it is twisted. Continual rotation of sleeve 316 by operation of gear box 308 winds spring 302 around shaft 301 which applies torsion force to shaft 301. As shown in FIG. 15, the coils of spring 302 contact each other when the spring is wound up. The colored spots 307 are helically located around spring 302 and represent the number of 360 degree twists of spring 302. Gear box 308 retains spring 302 in the wound position as worm gear 323 and worm 326 must be turned to operate gear box 308. Gear box 308 can be driven in a reverse direction to unwind spring 302 to relieve torsion force on shaft 301 to allow the cables and drums can be adjusted, repaired or replaced when spring torsion has been released. Gear box 308 is also operated to adjust the tension of spring 302.

While several preferred embodiments of the roll-up door counterbalancing assembly has been disclosed, it is to be understood that one skilled in the art to which the invention pertains may make changes in the parts and arrangement of the parts and materials without departing from the invention.

What is claimed is:

1. An apparatus for applying a torsion force to a spring on a shaft, wherein a first end of the spring is secured to the shaft, the apparatus comprising:

a housing mountable to a structure adjacent to the shaft;

a transmission rotatably mounted within the housing and configured for positioning coaxially around the shaft; and a connector coupled to the transmission and configured for positioning coaxially around the shaft, the connector further configured for connection to a second end of the spring on the shaft, wherein the connector comprises:

a tubular member having a first tubular section rotatably connected to the transmission and a second tubular section extending from the housing, the second tubular section having an outer surface configured with external threads; and a nut having internal threads mateable with the external threads of the second tubular section, the nut configured for connection to the second end of the spring.

2. The apparatus of claim 1 wherein the transmission comprises:

a first gear having a head external to the housing; and a second gear meshed with the first gear, the second gear being connected to the connector.

3. The apparatus of claim 2 wherein the first gear comprises a worm gear, and wherein the second gear comprises a wheel gear.

4. An apparatus for applying a torsion force to a spring on a shaft, wherein a first end of the spring is secured to the shaft, the apparatus comprising:

a housing mountable to a structure adjacent to the shaft;

metal tube capable of being positioned coaxially over the shaft, the metal tube comprising a first tubular section rotatably mounted within the housing, and a second tubular section extending from the housing, the second tubular section configured with external threads;

a wheel gear secured to the first tubular section of the metal tube;

a worm gear engaging the wheel gear, the worm gear having a head external to the housing for turning the worm gear; and a connector configured for threading on the second tubular section and for a connection of a second end of the spring on the shaft.

5. The apparatus of claim 4 wherein the metal tube comprises a stop between the first and second tubular sections.

6. The apparatus of claim 5 wherein the stop is located at an intersection of the first and second tubular sections.

7. The apparatus of claim 5 wherein the housing comprises a first bearing circumjacent a first portion of the first tubular section.

8. The apparatus of claim 7 wherein the housing comprises a second bearing circumjacent a second portion of the first tubular section.

9. The apparatus of claim 5 wherein the head of the worm gear comprises a hexagonal head.

* * * * *

UNITED STATES PATENT AND TRADEMARK OFFICE

CERTIFICATE OF CORRECTION

PATENT NO. : 6,615,897 B2
DATED : September 9, 2003
INVENTOR(S) : Edward Dorma

It is certified that error appears in the above-identified patent and that said Letters Patent is hereby corrected as shown below:

Title page,
Item [56], References Cited, U.S. PATENT DOCUMENTS, Patent No. 5,239,777, delete, "8/1993" and insert -- 3/1993 --

Column 2,
Line 43, delete "con figured" and insert -- configured --

Column 3,
Line 31, delete ","

Column 4,
Line 51, delete "would" and insert -- wound --

Column 6,
Line 39, delete ","

Signed and Sealed this

Thirteenth Day of April, 2004

JON W. DUDAS
*Acting Director of the United States Patent and Trademark Office*